US005259485A

United States Patent [19]

Jackson

[11] Patent Number: 5,259,485

[45] Date of Patent: Nov. 9, 1993

[54] TRUCK CAR BRAKING SYSTEM

[75] Inventor: Robert G. Jackson, Benton Harbor, Mich.

[73] Assignee: Triax Tube Company, Benton Harbor, Mich.

[21] Appl. No.: 956,368

[22] Filed: Oct. 5, 1992

[51] Int. Cl.[5] ..... B61H 13/02

[52] U.S. Cl. ..... 188/198; 188/52; 188/200; 188/205 A; 188/207

[58] Field of Search ..... 188/200, 198, 196 R, 188/196 B, 196 V, 202, 203, 205 A, 205 R, 207, 217, 219.1, 220.1-233.7, 382, 153 R, 52

[56] References Cited

U.S. PATENT DOCUMENTS

| | | | |
|---|---|---|---|
| 1,227,940 | 5/1917 | Sauvage | 188/205 A |
| 1,461,549 | 7/1923 | Withrow et al. | 188/205 A |
| 1,820,720 | 8/1931 | Withrow | 188/205 A |
| 1,820,721 | 8/1931 | Withrow | 188/205 A |
| 3,595,346 | 7/1971 | Kirk et al. | 188/200 |
| 4,079,818 | 3/1978 | Chierici | 188/207 |
| 4,771,868 | 9/1988 | Haydu | 188/52 |
| 4,795,007 | 1/1989 | Murphy et al. | 188/207 |
| 5,069,312 | 12/1991 | Kanjo et al. | 188/52 |

*Primary Examiner*—Douglas C. Butler
*Attorney, Agent, or Firm*—James D. Hall; Thomas J. Dodd

[57] ABSTRACT

A slack adjuster adapted for use in railroad truck car braking mechanisms. The slack adjuster compensates for wear of the truck car brake shoes by automatically adjusting the length of travel of the brake cylinder piston rod as the shoes wear. The slack adjuster of this invention includes a linkage connected between the air cylinder piston rod and one end of the slack adjuster. The invention also includes a bolster mounted linkage stabilizer which interconnects the other end of the slack adjuster, the brake lever, and the piston rod to eliminate oscillation of the piston rod during operation.

6 Claims, 6 Drawing Sheets

TRUCK CAR BRAKING SYSTEM

FIELD OF THE INVENTION

This invention relates to brake slack adjusters and will have special application to slack adjusters used in railroad truck car brake mechanisms.

BACKGROUND OF THE INVENTION

Slack adjusters are conventional devices incorporated into most railroad truck car brake systems. Such slack adjusters are used to adjust the travel of the air cylinder piston rod and the associated brake beams to compensate for brake shoe wear.

Typically, a slack adjuster is connected between the two brake beams, and is connected for pivoting movement at a terminal end to the brake cylinder rod and one brake beam through a force application lever. As the brake shoes wear due to use, the length which the brake cylinder rod must travel is increased. The slack adjuster, which is typically a spring loaded rod fitted in a cylinder, is also attached to the other brake beam, with the rod serving to actuate its associated brake beam so that both beams move in unison. The slack adjuster rod movement is controlled by a ratchet-pawl type mechanism which locks the rod in place to ensure that equal pressure is delivered all four brake shoes regardless of the wear condition.

Prior art slack adjusters provided no compensation for the vibrational forces which act on the brake cylinder rod during braking operations. As the brake shoes contact the truck car wheels, vibrational force is transmitted to the brake assembly, which causes the cylinder rod to oscillate from side to side. The further the rod is extended due to brake shoe wear, the more vibrational force is transmitted to the rod. Such side-to-side oscillation, even in small amounts, causes cylinder air leakage. If enough air leaks out of the cylinder, braking power is reduced or can be lost totally.

SUMMARY OF THE INVENTION

This invention relates to a slack adjuster and a connecting linkage stabilizer which virtually eliminates the oscillating movement of the cylinder rod during braking operations. The stabilizer is connected between the cylinder rod end and a fixed bracket which is connected to the brake beams. During operations, even with worn shoes, vibrational forces are transferred to and absorbed the stabilizer.

Accordingly it is an object of this invention to provide for a novel and improved slack adjuster for railroad truck car braking systems.

Another object is to provide for a truck car slack adjuster stabilizer which reduces or eliminates oscillating movement of the air cylinder push rod during braking.

Another object is to provide a truck car brake stabilizer which is efficient, simple to maintain and economical.

Other objects will become apparent upon a reading of the following description.

BRIEF DESCRIPTION OF THE DRAWINGS

A preferred embodiment has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others to follow its teachings.

Figure 1:
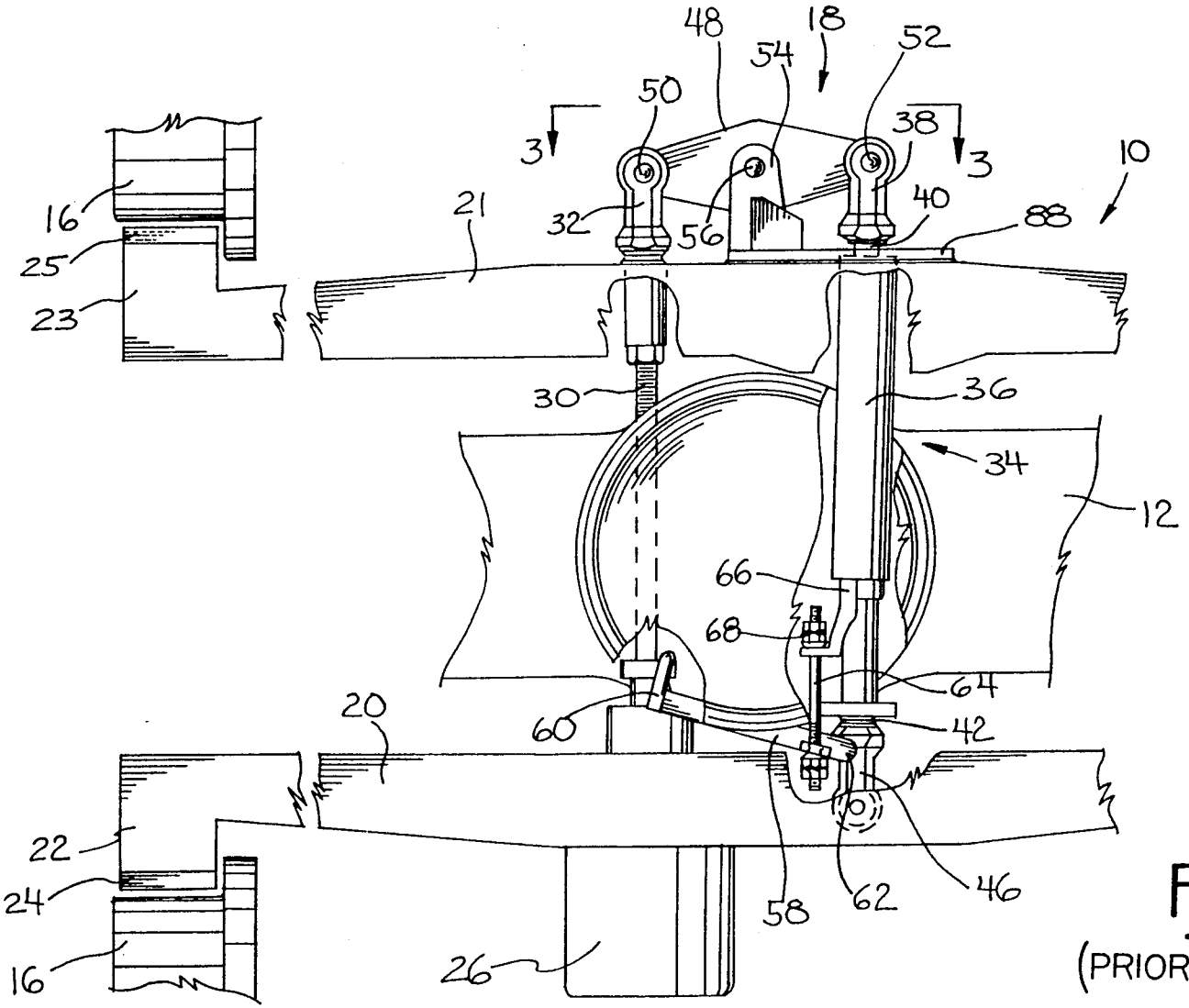
Fig. 1 (PRIOR ART)
FIG. 1 is a top plan view of a typical truck car brake system illustrating the beams in a standby position.
Figure 2:
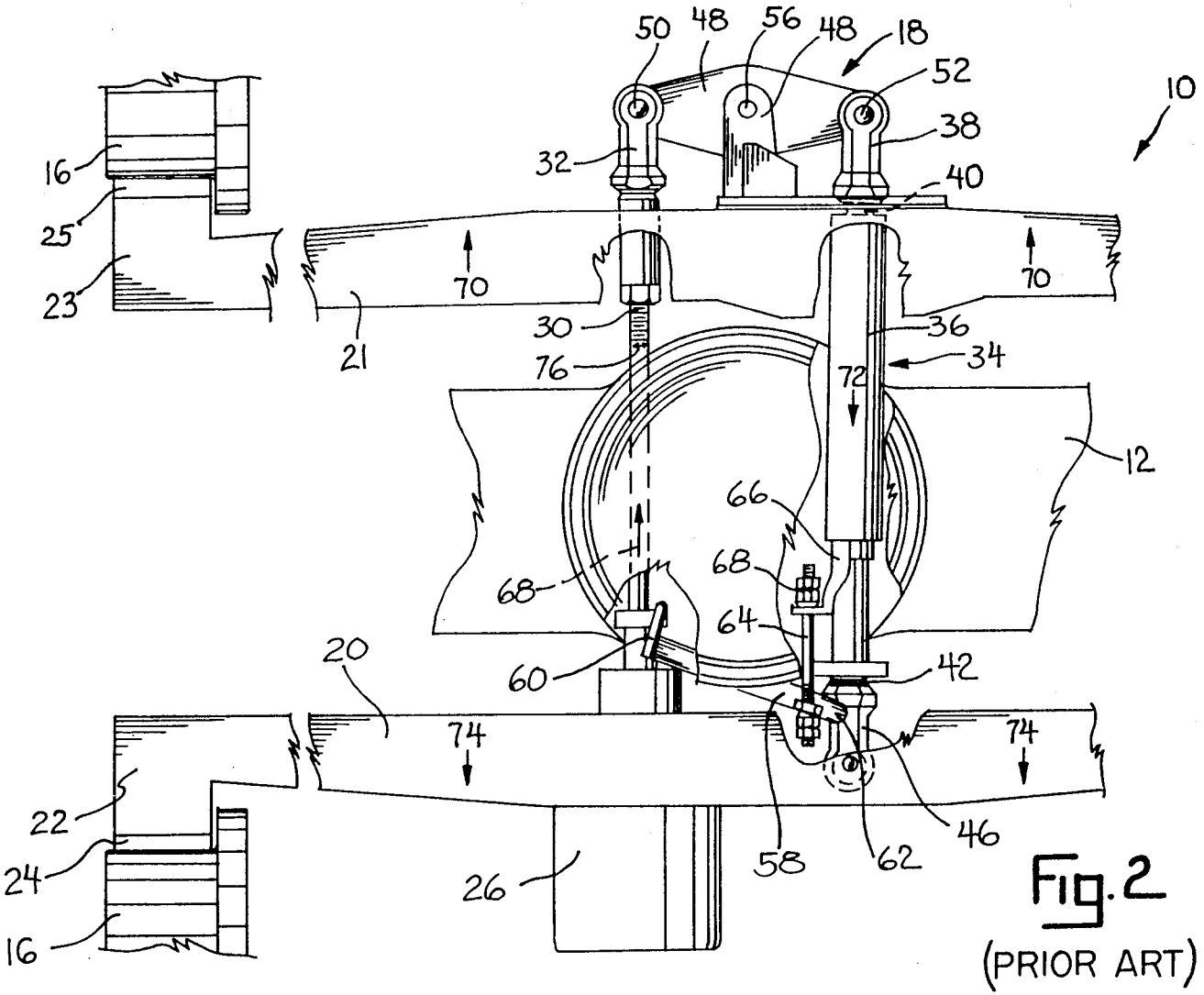
Fig. 2 (PRIOR ART)
FIG. 2 is a top plan view of the truck car brake system of FIG. 1 with the beams in a braked position.

Referring first to FIGS. 1 and 2, reference numeral 10 refers generally to a conventional railroad truck car frame which is shown in fragmented form for simplicity. Frame 10 includes a bolster 12 which spans side frame members (not shown) and is oriented generally parallel to the end frame members (not shown) of the truck. Wheels 16 are rotatably connected in a conventional manner to the truck side frame members.

Figure 3:
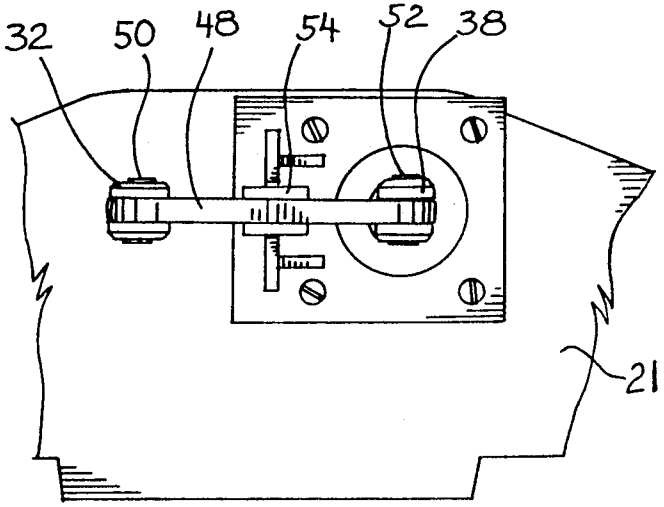
Fig. 3 (PRIOR ART)
FIG. 3 is an end view as seen from line 3—3 of FIG. 1.

Reference numeral 18 refers generally to the conventional braking system currently employed on some trucks to slow forward momentum, as seen in FIGS. 1-3. Braking system 18 as shown, includes generally brake beams 20, 21 oriented generally parallel to bolster 12 and located on both sides thereof. Each beam 20, 21 includes terminal brake heads 22, 23 (one shown) each of which carries a brake shoe 24 and 25, respectively.

Beams 20, 21 are connected to bolster 12 for movement between a standby position (FIG. 1) and a braked position (FIG. 2) with the brake shoes contacting truck wheels 16 to impede forward momentum Air cylinder 26 is fixedly mounted to brake beam 20 as by conventional fasteners (not shown) and includes push rod 30 which extends through bolster 12 and is fixedly connected to brake beam 21. A clevis 32 is connected to the terminal end of push rod 30 and extends outwardly of beam 21 as shown.

Beams 20, 21 are also movably connected to bolster 12 by slack adjuster assembly 34. Slack adjuster 34 typically includes a cylinder 36 which houses extensible rod 40. A clevis 38 is fixedly connected to one terminal end of rod 40 and protrudes outwardly of beam 21. Cylinder 36 extends freely through beam 21 and bolster 12. A threaded rod 42 is movably connected to cylinder 36 by a common ratchet/pawl mechanism (not shown). Clevis 46 is fixedly connected to threaded rod 42 and to beam 20 as shown.

Brake lever 48 is connected between clevises 32 and 38 by pivot pins 50, 52 respectively. A fulcrum 54 is connected to beam 21 through bracket 88 approximately half way between clevis 32 and clevis 38. Lever 48 is pivotally joined to fulcrum 54 by pivot pin 56 as shown.

Air cylinder rod 30 may be operably connected to slack adjuster 34 as follows. A cam lever 58 is fixedly connected at one end 60 to cylinder rod 30. The other end 62 of cam lever 58 is connected to bolt 64. Bolt 64 is fixedly connected to slack adjuster cylinder 36 as by bracket 66. Nuts 68 secure bolt 64 to cam lever 58 and to bracket 66 as shown. Other working parts of brake assembly 18, such as the handbrake, have been omitted for purposes of clarity.

Brake assembly 18 operates to slow and stop truck car 10 as follows. With the brake assembly 18 in the standby position shown in FIG. 1, a brakeman actuates air cylinder 26 in a common manner. When actuated, cylinder rod 30 extends toward brake beam 21 in the direction of arrow 68. The fixed connection of rod 30 to beam 21 causes corresponding movement of the beam 21 in the direction shown by the arrows 70, with the brake shoes 24 contacting wheels 16 to slow the car 10 by friction, as shown in FIG. 2.

As the cylinder rod 30 is moved, the fixed connection of cam lever 58 to bolt 64 and slack adjuster 54 urges the slack adjuster cylinder 36 in the direction of arrow 72. The fixed connection of clevis 46 to threaded rod 42 and beam 20 causes the corresponding movement of beam 20 in the direction of arrows 74, until brake shoes 25 contact wheels 16 to ensure simultaneous four-wheel braking.

As brake shoes 24, 25 contact moving wheels 16, 17, a tremendous amount of vibrational force is generated. The greatest amount of this force is observed as shoes 24, 25 wear from the friction generated by contact with wheels 16. This vibrational force causes cylinder rod 30 to vibrate sideways in the direction of arrow 76 and often results in air or fluid leakage from within cylinder 26. As is shown in the railroad industry, if enough air or fluid leaks out of cylinder 26, brake failure may result, and often requires frequent replacement of the air cylinders.

FIGS. 4–7 illustrate the novel and improved brake assembly 78 of this invention. As shown in these figures, the improved brake assembly 78 includes a stabilizer linkage 80 which is shown in exploded form in FIG. 7, and attached to the brake assembly 78 in FIGS. 4–6.

Figure 7:
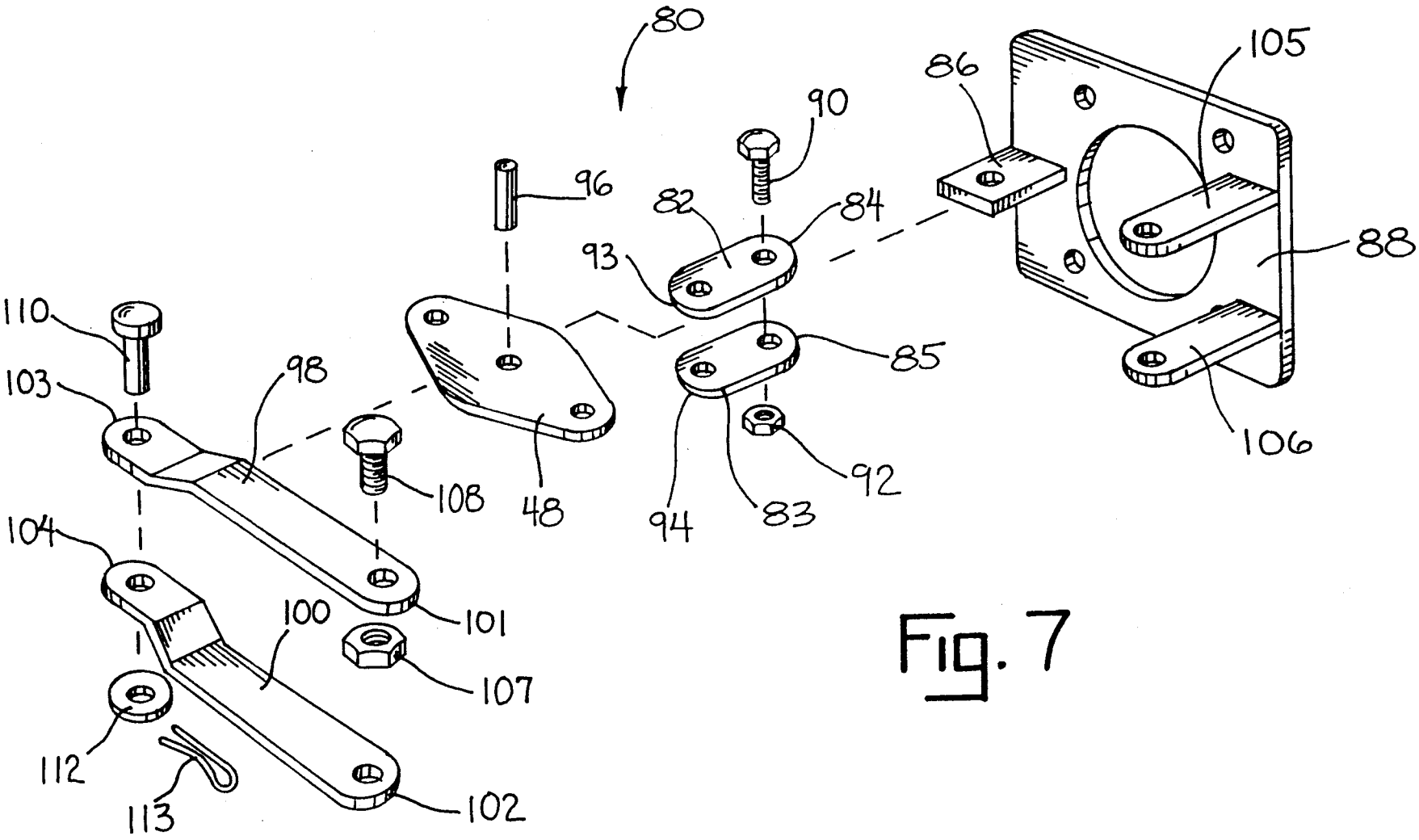
FIG. 7 is an exploded view of the stabilizer linkage.

As shown in FIG. 7 linkage 80 includes force application levers 82, 83 which are secured at one end 84, 85 to post 86 of a lever bracket 88 as by bolt 90 and nut 92. Levers 82, 83 have their opposite ends 93, 94 secured to brake lever 48 as by pin 96.

Figure 6:
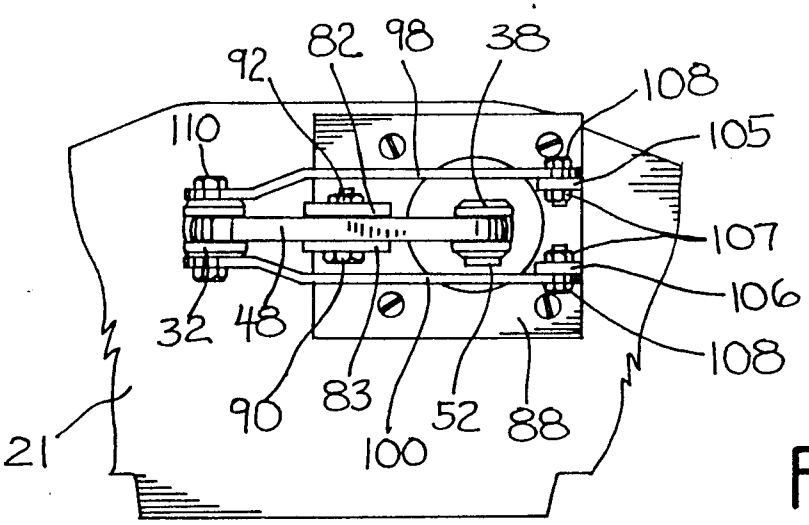
FIG. 6 is an end view as seen from line 6—6 of FIG. 4.
Figure 4:
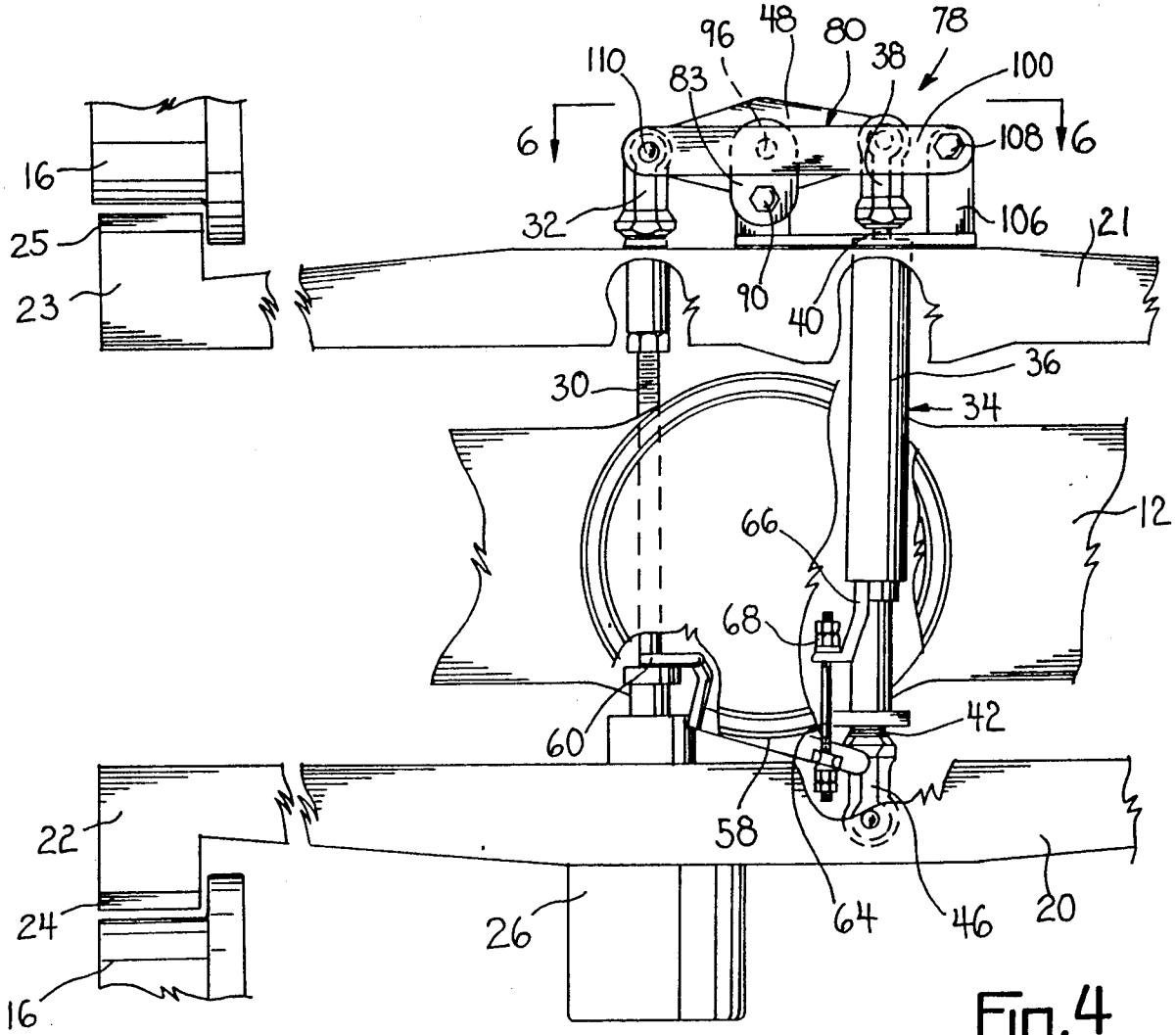
FIG. 4 is a top plan view of the truck car brake system of this invention with the brake beams in a standby position.
Figure 5:
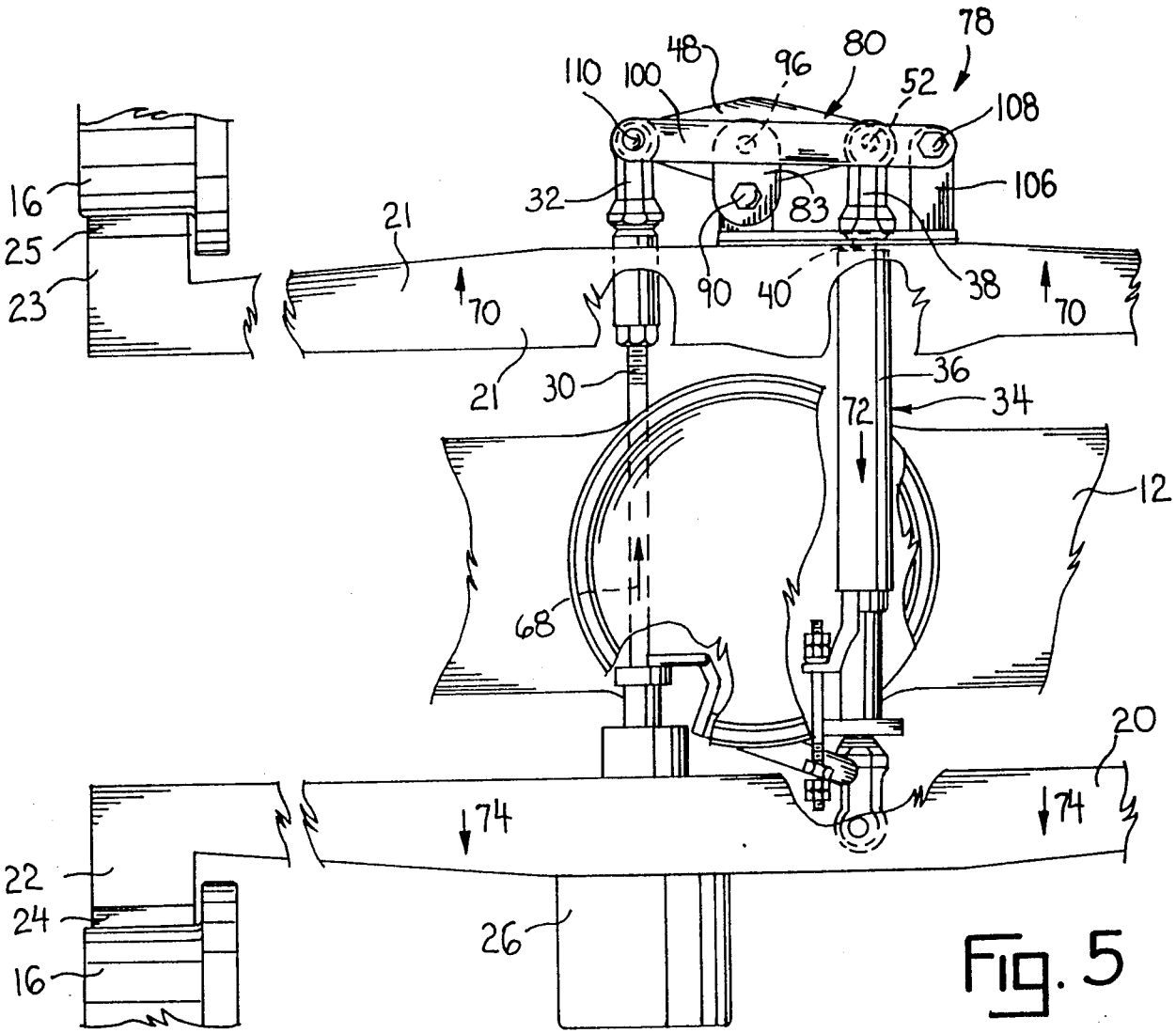
FIG. 5 is a top plan view of the brake system of FIG. 4 with the beams in a braked position.

Linkage 80 also includes stabilizer links 98 and 100, which have ends 101, 102 and 103, 104, respectively. Links 98, 100 have their ends 101, 102 connected to posts 105, 106, respectively, of bracket 88 as by nuts and bolts 107, 108 (only one shown in FIG. 7). The other ends 103, 104 of links 98, 100 are connected as by pin 110 and washers 112 and cotter pin 113 to clevis 32 of cylinder rod 30 as shown in FIG. 6.

Brake assembly 78 operates in the same manner to slow and stop car 10 as brake assembly 18. However, as friction increases and the brake shoes 24, 25 wear, the stabilizer linkage 80 effectively absorbs enough of the resultant vibrational forces generated by transferring some of the force to posts 105, 106 of lever bracket 88. This reduces and in most cases eliminates the vibration of rod 30 and prevents fluid leakage from air cylinder 26. For clarity, the numbers for the remaining parts of brake assembly 78 are the same as those used in brake assembly 18.

It is understood that the above description does not limit the invention to the above details, but may be modified within the scopes of the following claims.

I claim:

1. In a braking system for railroad truck cars, said braking system including opposing brake beams positioned adjacent to wheels of a truck car, each brake beam carrying brake shoes for contacting said wheels as the beams are shifted into a braked position, means connected to said beams for shifting the beams between a standby position and said braked position, said means for shifting including a fluid powered cylinder having an extensible rod connected to one of said beams and a slack adjuster having an extensible rod connected to another of said beams, and lever means connected between said cylinder rod and one end of said slack adjuster for effecting correlative movement of the beams, the improvement comprising stabilizer means for absorbing vibrational forces during shifting of the brake beams into said braked position, and means for connecting said stabilizer means between one end of said cylinder rod and said one brake beam.

2. The braking system of claim 1 and a fulcrum connected to said one brake beam between one end of said cylinder rod and said slack adjuster one end, said lever means connected to said fulcrum, said stabilizer means including first and second stabilizer bars connected at a first end thereof to said lever means at said cylinder rod end.

3. The braking system of claim 2 and a bracket connected to said one brake beam, each first and second stabilizer bars having a second end fixedly connected to said bracket.

4. In combination, a railroad truck car and a braking system, said truck car including a frame, wheels mounted to said frame for rotational movement relative thereto, said braking system comprising first and second brake beams having brake shoes positioned adjacent to said wheels, means for shifting each brake beam between a standby position spaced from said wheels and a braked position wherein said brake shoes contact said wheels, said means for shifting including a power actuated cylinder having an extensible rod connected at a first end thereof to said first brake beam, and a slack adjuster having a first end connected to said first brake beam and an extensible rod connected to said second brake beam, a lever arm pivotally connected between said cylinder rod first end and said slack adjuster first end, and a stabilizer means for limiting vibrational forces on said cylinder rod as the beams are shifted into their braked position, and means for connecting said stabilizer bar means between said cylinder rod one end and said first brake beam.

5. The combination of claim 4 wherein said means for connecting includes a bracket, means for fastening said bracket to said first brake beam, said bracket including first spaced posts extending therefrom, said stabilizer means including first and second bars each having a first end and a second end, means for connecting each bar first end to said first spaced posts, and pin means for connecting each bar second end to said extensible rod.

6. The combination of claim 5 wherein said stabilizer means further includes a brake lever having first and second ends, said bracket including a second post spaced from said first posts, said bracket defining an opening therethrough with said slack adjuster first end extending through said opening, linkage means for connecting said brake lever to said second post, said pin means connecting said brake lever at the first end thereof to said extensible rod and said bars, and fastener means for connecting said brake lever at the second end thereof to said slack adjuster first end.

* * * * *